US006144834A

United States Patent [19]

Thayer

[11] Patent Number: 6,144,834

[45] Date of Patent: Nov. 7, 2000

[54] SELF BIASING, EXTENDED NIP ELECTROSTATIC CLEANER

[75] Inventor: Bruce E. Thayer, Webster, N.Y.

[73] Assignee: Xerox Corporation, Stamford, Conn.

[21] Appl. No.: 09/407,759

[22] Filed: Sep. 28, 1999

[51] Int. Cl.[7] ..... G03G 21/00

[52] U.S. Cl. ..... 399/352; 15/256.5; 399/353

[58] Field of Search ..... 399/352, 71, 123, 399/353, 354, 355, 358, 360; 15/256.52, 1.51, 256.5

[56] References Cited

U.S. PATENT DOCUMENTS

| | | | |
|---|---|---|---|
| 3,795,025 | 3/1974 | Sadamitsu | 15/256.52 |
| 4,320,774 | 3/1982 | Rogers | 132/11 A |
| 4,457,615 | 7/1984 | Seanor | 355/3 CH |
| 4,878,093 | 10/1989 | Edmunds | 355/296 |
| 4,999,679 | 3/1991 | Corbin et al. | 355/303 |
| 5,257,079 | 10/1993 | Lange et al. | 355/303 |
| 5,381,218 | 1/1995 | Lundy | 355/298 |
| 5,671,472 | 9/1997 | Snelling | 399/308 |
| 6,072,294 | 6/2000 | Mashtare et al. | 15/1.51 |
| 6,085,061 | 6/2000 | Snelling | 399/353 |

*Primary Examiner*—Quana M. Grainger
*Attorney, Agent, or Firm*—Linda M. Robb

[57] ABSTRACT

An apparatus for cleaning particles from a surface including a conductive flexible brush belt having a piezoelectric exterior layer to which is attached conductive brush fibers which contact the surface to be cleaned. A support member, about which the belt is entrained, provides sufficient deformation to the belt to cause a voltage to be developed on the surface of the piezoelectric exterior layer in response to being deformed. The voltage causes particles to adhere to the conductive brush fibers. The particles are removed from the brush fibers at a detoning station.

13 Claims, 4 Drawing Sheets

SELF BIASING, EXTENDED NIP ELECTROSTATIC CLEANER

BACKGROUND OF THE INVENTION

This invention relates generally to an electrostatographic printer or copier, and more particularly concerns a flexible belt cleaning apparatus used therein.

In an electrophotographic application such as xerography, a charge retentive surface (i.e., photoconductor, photoreceptor or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. This process is well known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. The fixed radius of commonly used brushes can limit cleaning applications. Toner particles adhere to the fibers (i.e. bristles) of the brush after the charge retentive surface has been cleaned. The process of removing toner from these types of cleaner brushes can be accomplished in a variety of ways. Typically, brush cleaners use flicker bars to provide the detoning function which may not sufficiently clean the particles from the brush fibers.

The following disclosures may be relevant to various aspects of the present invention and may be briefly summarized as follows:

U.S. Pat. No. 4,320,774 to Rogers discloses a mechanical toothbrush with a brush drive unit coupled to a rotating device such as an electric motor. The brush drive unit alternately rotates a first belt brush in a first direction while maintaining a second belt brush in a substantially fixed position and rotates the second belt brush in a second direction while maintaining the first belt brush in a substantially fixed position.

U.S. Pat. No. 4,457,615 to Seanor discloses a belt brush constructed of alternate conductive and non-conductive segments which causes one conductive segment which is being used for charging to be electrically isolated from another conductive segment which is being used for cleaning. Different voltages can be simultaneously applied to each of the segments without adversely affecting the operation of the other. A single detoning roller is provided to remove toner particles from the brush.

U.S. Pat. No. 5,381,218 to Lundy discloses a conductive flexible cleaner brush belt having a plurality of detoning stations to remove particles from the brush fibers. At least one of the rollers about which the flexible belt brush is mounted has a small diameter for spreading the brush fibers apart. The spreading of the fibers creates a node affect as the fibers rebound, with adjacent fibers opening to create a moving node affect. An air vacuum removes the particles from the brush fibers.

SUMMARY OF THE INVENTION

Briefly stated, and in accordance with one aspect of the present invention, there is provided an apparatus for cleaning particles from a surface. The apparatus includes a flexible brush belt, which includes a piezoelectric exterior layer for generating a voltage on the surface of the belt in response to being deformed. Attached to the piezoelectric exterior layer is a multiplicity of conductive brush fibers extending outwardly therefrom with the fibers contacting the surface for removal of particles therefrom. A supporting device, about which the belt is entrained, provides sufficient deformation to the belt to cause a voltage to be developed on the surface of the brush belt to facilitate the cleaning of toner particles from a surface. A detoning device cooperates with the belt brush to remove particles therefrom.

In accordance with another aspect of the present invention, there is provided an electrostatographic printing machine. The printing machine includes a photoreceptor, which has a photoconductive surface, a charging station for charging the photoconductive surface to a predetermined potential, an exposure station, a development station, a transfer station, a fusing station, and a cleaning station. The cleaning station includes a flexible brush belt, which includes a piezoelectric exterior layer to which is attached a multiplicity of conductive brush fibers extending outwardly therefrom to contact the surface to be cleaned. The brush belt is entrained about a supporting device, which provides deformation to the belt. A detoning device cooperates with the belt brush to remove particles therefrom.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
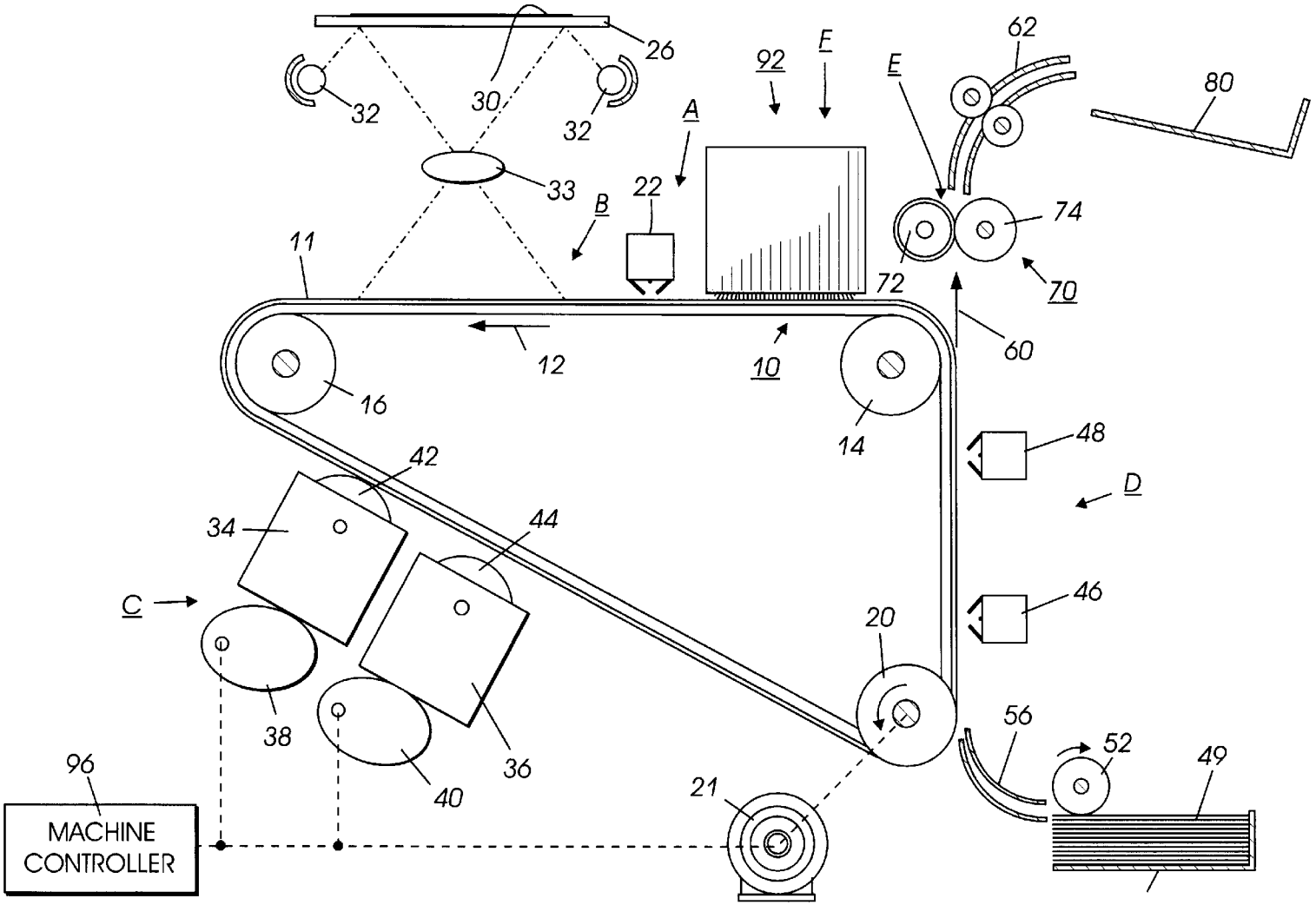
FIG. 1 is a schematic illustration of a printing apparatus incorporating the inventive features of the present invention.

For a general understanding of an electrophotographic printer or copier, in which the present invention may be incorporated, reference is made to FIG. 1, which depicts schematically the various components thereof. Hereinafter, like reference numerals will be employed throughout to designate identical elements. Although the dual polarity electrostatic belt cleaner apparatus of the present invention is particularly well adapted for use in an electrophotographic printing machine, it should become evident from the following discussion that it is equally well suited for use in other applications and is not necessarily limited to the particular embodiment shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers, which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative.

At exposure station B, an original document 30 is positioned face down on a transparent platen 26 for illumination with flash lamps 32. Light rays reflected from the original document are reflected through a lens 33 and projected onto the charged portion of the photoreceptor belt 10 to selectively dissipate the charge thereon. This records an electrostatic latent image, which corresponds to the informational area contained within the original document, onto the belt. Alternatively, a laser may be provided to image-wise discharge the photoreceptor in accordance with stored electronic information.

Thereafter, the belt 10 advances the electrostatic latent image to developing station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet. After transfer, the corona generator 48 charges the copy sheet to an opposite polarity to de-tack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60, to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the photoreceptor belt 10 after each copy is made, may be removed at cleaning station F. The cleaning apparatus of the present invention is represented by the reference numeral 92, which will be described in greater detail in FIGS. 2 through 5. Removed residual particles may also be stored for disposal.

A machine controller 96 is preferably a known programmable controller or combination of controllers, which conventionally control all of the machine steps and functions described above. The controller 96 is responsive to a variety of sensing devices to enhance control of the machine, and also provides connection diagnostic operations to a user interface (not shown) where required.

Figure 2:
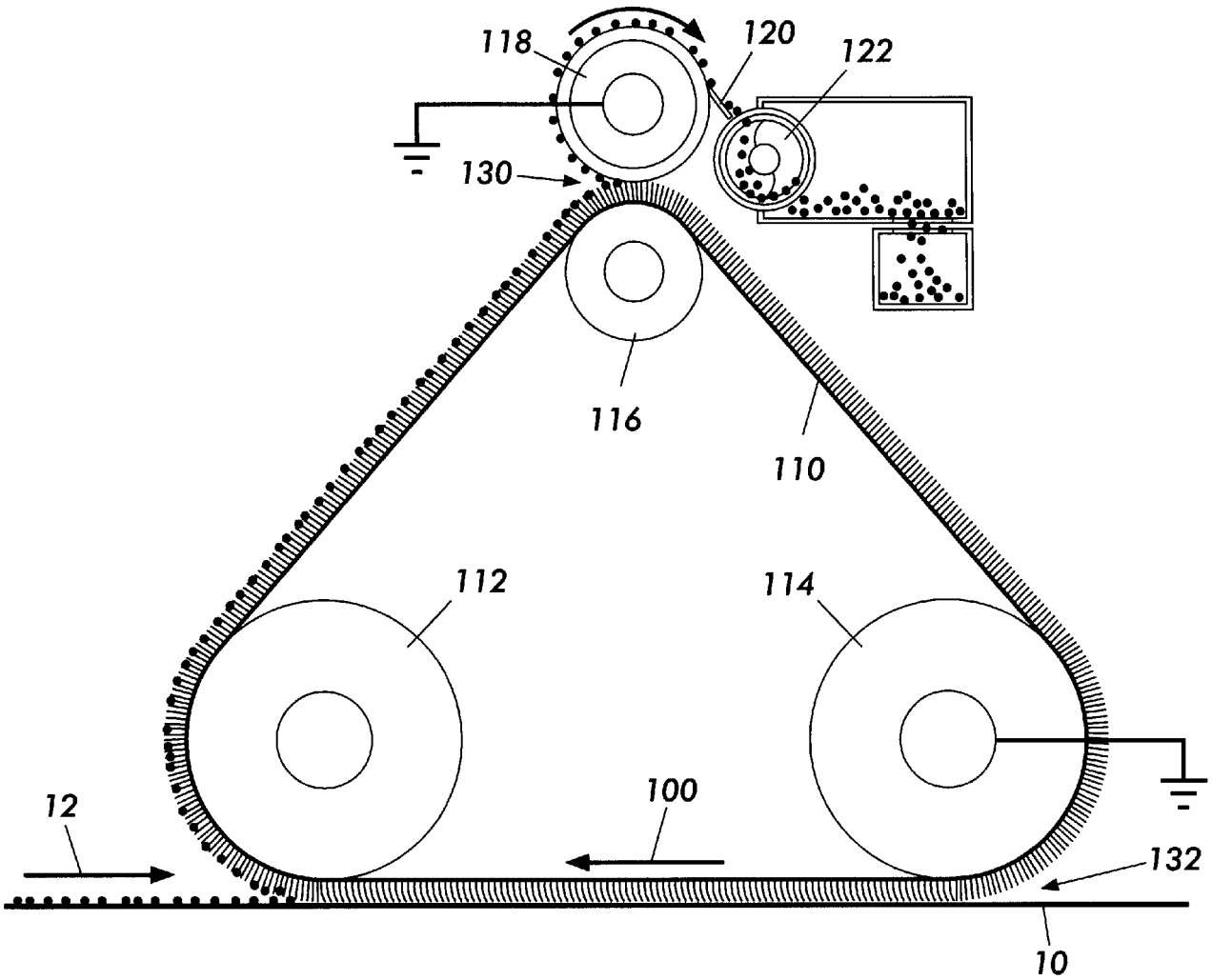
FIG. 2 is an elevational view of the present invention.

As thus described, a reproduction machine in accordance with the present invention may be any of several well-known devices. Variations may be expected in specific electrophotographic processing, paper handling and control arrangements without effecting the present invention. However, it is believed that the foregoing description is sufficient for purposes of the present application to illustrate the general operation of an electrophotographic printing machine which exemplifies one type of apparatus employing the present invention therein. Reference is now made to FIG. 2, in which the showings are for the purpose of illustrating preferred embodiments of the present invention and not for limiting the same.

FIG. 2 shows an elevational view of the preferred embodiment of the present invention. The dual polarity electrostatic cleaner is comprised of a belt 110 entrained about rollers 112, 114, and 116 and moving in direction 100 opposed to the movement of photoreceptor belt 10. The two larger diameter rollers 112 and 114 support the belt 110 in brushing contact with photoreceptor belt 10. The third smaller diameter roller 116 forms a detoning nip 130 with an electrostatic detoning roll 118. Belt 110 is comprised of a continuous loop of conductive backing material (i.e. a piezoelectric polymer film, such as polyvinylidene fluoride (PVDF)) to which conductive brush fibers are attached.

Figure 3:
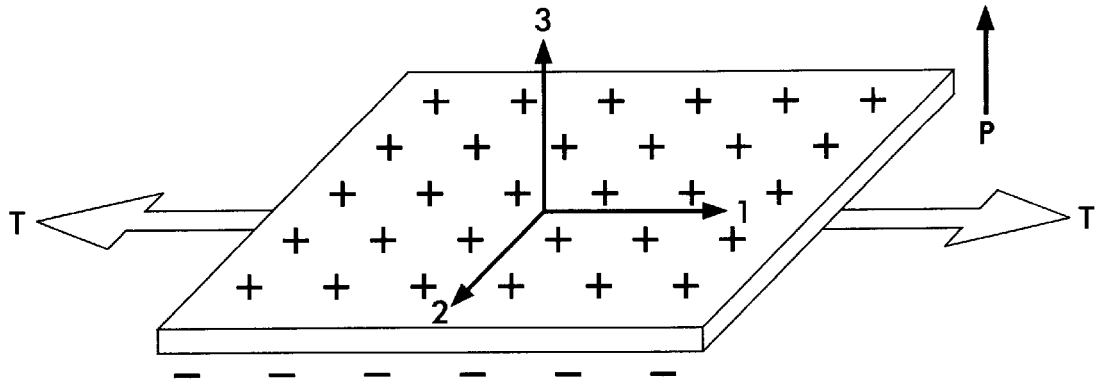
FIG. 3 is an illustration of the geometry of a piezoelectric sheet.

FIG. 3 illustrates the geometry associated with a piezoelectric sheet. PVDF materials are formed by stretching the film in one direction and applying a large electric field to electrically polarize it in a direction perpendicular to the film. In FIG. 3, the stretch direction is denoted by "1" and the polarization direction is denoted by "3". When a PVDF sheet is strained, it develops an internal electric field, which is proportional to the deformation.

Figure 4:
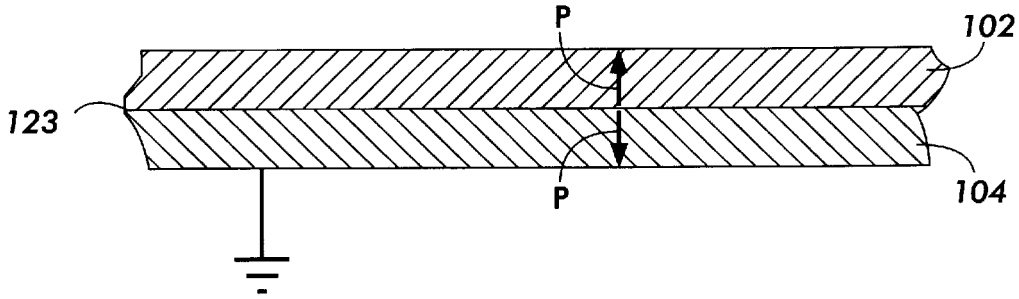
FIG. 4 is an illustration of a Xeromorph (bimorph) sheet.
Figure 5:
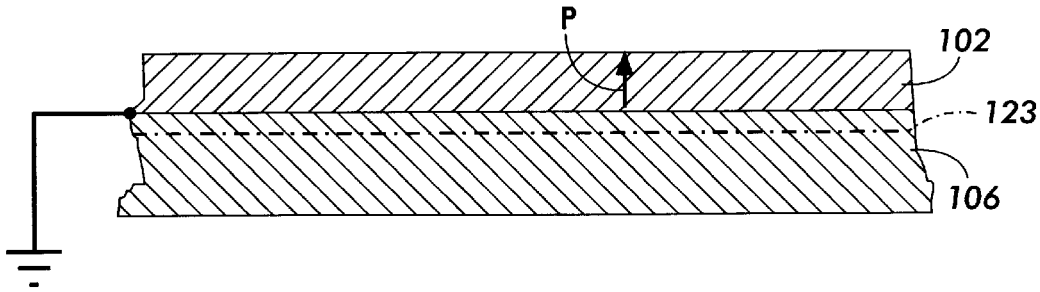
FIG. 5 is an illustration of a Xeromorph (unimorph) sheet.

Referring now to FIGS. 4 and 5, the present invention utilizes either a bimorph or a unimorph structure referred to as a "Xeromorph". A bimorph Xeromorph consists of two PVDF sheets 102 and 104 laminated together, with each sheet polarization direction opposed to each other and having only a bottom electrode, as shown in FIG. 4. The composite bimorph belt will have a neutral axis in bending 123 at the center of the belt thickness. If, relative to FIG. 4, the ends of the belt are bent downward, the top piezoelectric layer 102 will be in tension and the bottom piezoelectric layer 104 will be in compression. If, relative to FIG. 4, the ends of the belt are bent upward, the top piezoelectric layer 102 will be in compression and the bottom piezoelectric layer 104 will be in tension. Reversing the strain, tension to compression, on the belt will reverse the polarity of the charge generated within the piezoelectric layers 102 and 104. The arrows P shown in FIG. 4 indicate the polarization direction used in manufacturing the piezoelectric material. When the piezoelectric material is in tension the surface of the material at the head of the arrow P will generate a negative voltage relative to the surface at the tail of the arrow P. Alternatively when the piezoelectric material is in compression the surface of the material at the head of the arrow P will generate a positive voltage relative to the surface of the material at the tail of the arrow P. A unimorph Xeromorph consists of a single PVDF sheet 102 laminated to a thick substrate 106 as shown in FIG. 5. The substrate material may comprise materials which can be bent, and have no piezoelectric properties. The composite unimorph belt will have a neutral axis in bending 123 near the center of the belt thickness. If, relative to FIG. 5, the ends of the belt are bent downward, the piezoelectric layer 102 will be in tension. If, relative to the figure, the ends of the belt are bent upward, the piezoelectric layer 102 will be in compression. Reversing the strain, tension to compression, on the belt will reverse the polarity of the charge generated within the piezoelectric layer 102. The arrow P shown in FIG. 5 indicates the polarization direction used in manufacturing the piezoelectric material. When the piezoelectric material is in tension the surface of the material at the head of the arrow P will generate a negative voltage relative to the surface at the tail of the arrow P. Alternatively when the piezoelectric material is in compression the surface of the material at the head of the arrow P will generate a positive voltage relative to the surface of the material at the tail of the arrow P. Although a xeromorph belt produced to produce a single polarization is suitable for many applications, high volume printing or copying applications may require that the xeromorph belt be produced such that there are regions of reversing polarization along the length of the belt. A belt with such regions of alternating polarity is included within the spirit and scope of the present invention and is illustrated in FIGS. 6 and 7.

Figure 6:
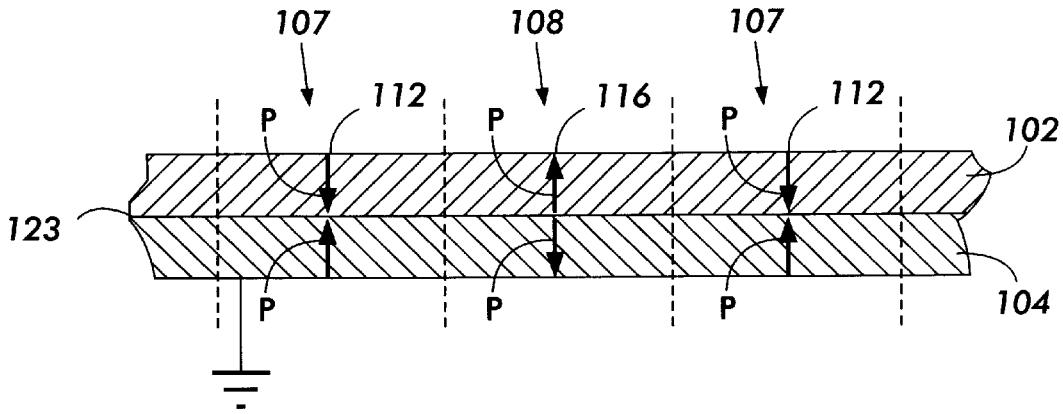
FIG. 6 is an illustration of a Xeromorph (bimorph) sheet of the present invention.

Referring now to FIG. 6, the bimorph shown is similar to the bimorph in FIG. 4 but additionally contains alternating regions 107 and 108 of polarization within the piezoelectric layers 102 and 104. The polarization region 108 behaves the same as the bimorph described in FIG. 4. When the ends of the belt in FIG. 6 are bent downward, a negative voltage is generated on the top surface 116 of the polarization regions 108 of the bimorph. Because the polarization directions of the piezoelectric layers are reversed in the polarization regions 107 relative to the polarization regions_108, the voltage generated at the surface 112 will be of opposite polarity to the voltage at the surface 116. Therefore, when the ends of the belt are bent downward in FIG. 6, the top surface 112 of the polarization regions 107 will generate a positive voltage. If the bending of the belt is reversed, the polarization regions 107 will generate negative voltages and the polarization regions 108 will generate positive voltages.

Figure 7:
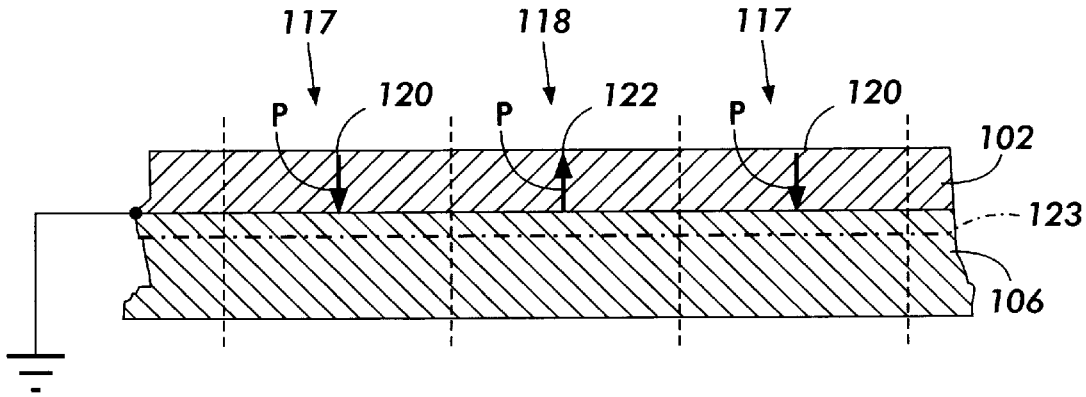
FIG. 7 is an illustration of a Xeromorph (unimorph) sheet of the present invention.

Referring now to FIG. 7, the unimorph shown is similar to the unimorph in FIG. 5 but additionally contains alternating regions 117 and 118 of polarization within the piezoelectric layer 102. The polarization regions 118 behave the same as the unimorph described in FIG. 5. When the ends of the belt in FIG. 7 are bent downward a negative voltage is generated on the top surface 122 of the polarization regions 118. Because the polarization directions of the piezoelectric layers are reversed in the polarization regions 117 relative to the polarization regions 118, the voltage generated at the surface 120 will be of opposite polarity to the voltage at the surface 122. Therefore, when the ends of the belt are bent downward in FIG. 7 the top surface 120 of the polarization regions 117 will generate a positive voltage. If the bending of the belt is reversed, the polarization regions 118 will generate positive voltages and the polarization 117 will generate negative voltages. For the sake of explanation, FIG. 6 and 7 show alternating regions of polarity that are approximately equal in length. However, it is readily appreciated that these regions may vary in length, depending on the polarity of the particles to be attracted to the conductive fibers. For example, if the majority of particles are negatively charged, it is desirable that the regions of positive polarization on the belt exceed in area those of negative polarization.

Referring once again to FIG. 2, belt 110 is sufficiently elastic and resilient to deform around roller 114, which is electrically grounded to create the reference electrical condition relative to the belt strain. As the belt 110 straightens on leaving the electrical reference roll 114 the belt strain decreases. The decrease in belt strain generates regions of positive and negative bias on the conductive fibers in the nip region 132 formed between photoreceptor belt 10 and belt 110. As belt 110 moves onto roller 112 the fiber biases return to zero volts since the belt has returned to its reference strain condition. On leaving roller 112 the belt bias returns to the values that existed in the nip region. As the belt 110 wraps around smaller diameter detoning nip backing roller 116, the fiber biases reverse polarity, caused by the increased strain experienced by the belt as it moves around the smaller diameter detoning nip backing roller 116, as compared to the electrical reference condition on the large diameter roller 112.

In operation, as a negative toner particle enters the cleaning nip 132 it is dislodged from the photoreceptor belt 10 and adheres to a positive biased fiber attached to belt 110. The positive biased fibers transport the toner particles to the detoning roll 118. As belt 110 wraps around the small diameter detoning nip backing roller 116, the polarity of the brush bias reverses. The negative toner particles then transfer from the negatively biased fiber to the grounded surface of detoning roll 118. The rotating detoning roll 118 then transports the toner particles to the detoning blade 120 that scrapes the toner particles off the detoning roll 118 and into an auger 122. The auger 122 transports the toner particles to a waste container.

It is therefore apparent that there has been provided, in accordance with the present invention, a dual polarity electrostatic belt cleaner that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

What is claimed is:

1. An apparatus for cleaning particles from a surface, comprising:

a flexible belt including a piezoelectric exterior layer for generating a voltage on a surface of said belt in response to being deformed, wherein said piezoelectric exterior layer is fabricated such that there are alternating regions of positive and negative polarity along the surface of said belt;

a multiplicity of conductive fibers extending outwardly from said belt with the fibers contacting the surface for removal of particles therefrom;

means for neutralizing the voltage on a portion of the surface of said belt;

a member for deforming a portion of the surface of said belt; and a detoning device, cooperating with said belt, to remove the particles from said fibers.

2. The apparatus of claim 1, wherein said piezoelectric exterior layer comprises:

a substrate; and a layer of piezoelectric polymer film laminated to said substrate.

3. The apparatus of claim 1, wherein said piezoelectric exterior layer comprises:

a first layer of piezoelectric polymer film having a first polarization direction; and a second layer of piezoelectric polymer film having a second polarization direction opposed to the first polarization direction.

4. The apparatus of claim 1, wherein said member comprises a plurality of rollers, said belt being entrained about said plurality of rollers to deform said piezoelectric exterior layer.

5. The apparatus of claim 1, wherein said detoning device comprises:

a detoning roll;

a detoning blade adjacent to said detoning roll to remove the particles from the detoning roll;

a waster toner chamber; and an auger to collect the particles from said detoning roll and transport the particles to said waste toner chamber.

6. The apparatus of claim 1, further comprising means for moving said belt at a predetermined velocity in a direction of movement.

7. The apparatus of claim 1, wherein the surface includes a photoreceptive surface.

8. The electrostatographic machine according to claim 1, further comprising means for moving said belt at a predetermined velocity in a direction of movement.

9. An electrostatographic machine comprising:

a photoreceptor having a photoconductive surface;

a charging station for charging said photoconductive surface to a predetermined potential;

an exposure station for exposing said photoconductive surface to produce a latent image thereon;

a development station for depositing development material on said charge retentive surface;

a transfer station for transfer of said development material adhered to said latent image onto print media;

a fusing station for fusing of said latent image onto said print media; and a cleaning station for removal of said development material remaining on said charge retentive surface after fusing, said cleaning station including: a flexible belt including a piezoelectric exterior layer fabricated such that there are alternating regions of positive and negative polarity along the surface of said belt and having a multiplicity of conductive fibers extending outwardly therefrom, a supporting device for movably supporting said belt, means for neutralizing the voltage on a portion of the surface of said belt, and a detoning device to remove particles from said belt.

10. The electrostatographic machine according to claim 9, wherein said piezoelectric exterior layer comprises:

a substrate; and a layer of piezoelectric polymer film laminated to said substrate.

11. The electrostatographic machine according to claim 9, wherein said piezoelectric exterior layer comprises:

a first layer of piezoelectric polymer film having a first polarization direction; and a second layer of piezoelectric polymer film having a second polarization direction opposed to the first polarization direction.

12. The electrostatographic machine according to claim 9, wherein said supporting device comprises a plurality of rollers, said belt being entrained about said plurality of rollers to deform said piezoelectric exterior layer.

13. The electrostatographic machine according to claim 9, wherein said detoning device comprises:

a detoning roll;

a detoning blade adjacent to said detoning roll to remove the particles from the detoning roll;

a waste toner chamber; and an auger to collect the particles from said detoning roll and transport the particles to said waste toner chamber.

* * * * *